US005967822A

United States Patent [19]

Kohata et al.

[11] Patent Number: 5,967,822

[45] Date of Patent: Oct. 19, 1999

[54] LOCK RELEASING MECHANISM OF A CONNECTOR

[75] Inventors: Takeo Kohata; Masayuki Yamamoto, both of Shizuoka, Japan

[73] Assignee: Yazaki Corporation, Tokyo, Japan

[21] Appl. No.: 08/939,530

[22] Filed: Sep. 29, 1997

[30] Foreign Application Priority Data

Sep. 30, 1996 [JP] Japan ..... 8-258954

[51] Int. Cl.[6] ..... H01R 11/11

[52] U.S. Cl. ..... 439/270

[58] Field of Search ..... 439/270, 456, 439/459

[56] References Cited

FOREIGN PATENT DOCUMENTS 50-151389 12/1975 Japan .
4-14775 1/1992 Japan .

*Primary Examiner*—Neil Abrams
*Assistant Examiner*—Eugene G. Byrd
*Attorney, Agent, or Firm*—Finnegan, Henderson, Farabow, Garrett & Dunner, L.L.P.

[57] ABSTRACT

A lock releasing mechanism of a connector in which connector terminals are received in terminal receiving chambers respectively in a manner that tongue pieces of the connector terminals are in opposition to each other, and a wiring groove is provided in the outside of the terminal receiving chambers so that all of electric wires connected to the connector terminals are laid in the same direction, whereby the connector terminals can be made the same with each other in configuration to thereby reduce the cost. Further, by pushing a single lock releasing member, lock releasing levers are moved to thereby simultaneously urge the tongue pieces of the connector terminals in opposition to each other to release the connector terminals in a lump from locking with partner-side connection terminals, whereby the workability in maintenance can be improved.

7 Claims, 11 Drawing Sheets

LOCK RELEASING MECHANISM OF A CONNECTOR

BACKGROUND OF THE INVENTION

1. Field of the Invention

The present invention relates to a lock releasing mechanism of a connector used for connecting wire harnesses in an automobile or connecting electrical devices to wire harnesses, and particularly relates to a lock releasing mechanism of a connector suitable for detaching various three-phase lamps.

2. Description of the Related Art

Recent automobiles are automated and mounted with AV devices and navigation systems. Inevitably, a large number of wiring materials such as wire harnesses, connectors, and so on, are used for connecting electronic devices to each other. On the other hand, running automobiles vibrate in accordance with the conditions of their engines and the roads. Therefore, there is a case where a lock mechanism is provided in an automobile so as to prevent the connectors from becoming disconnected undesirably causing accidents such as circuit breaking and so on.

A connector with a conventional lock mechanism will be described with reference to FIGS. 10 to 14. This connector 61 has a housing 62 integrally molded with synthetic resin, three connector terminals 64*a*, 64*b* and 64*c* buried in terminal receiving chambers 63 (see FIG. 10) formed in the housing 62, electric wires 65*a*, 65*b* and 65*c* connected to the respective connector terminals 64*a*, 64*b* and 64*c*, and a lock mechanism 91 which is described below.

Each of the connector terminals 64*a*, 64*b* and 64*c* which is arranged by using a metal plate as shown in FIGS. 12 to 14 and has a base plate 71 and vertical side walls 72 forming a box-like structure. A free edge portion of each of the side walls 72 is bent onto the base plate 71 to form a flange edge 73. A tongue piece 74 formed integrally with the front end of the base plate 71 is extended backward with a gentle slope between the side walls 72. A free end of the tongue piece 74 is bent outward at a right angle to form a releasing operation portion 75.

In addition, a lock lance 76 for engaging with a partner-side plug terminal 81 is provided at the center portion of the tongue piece 74. Further, at the rear end of the base plate 71, one of the electric wires 65*a*, 65*b* and 65*c* is connected by solderless contact through a clamping portion 78 as shown by the dotted lines.

The partner-side plug terminal 81 having a lock hole 82 is inserted between the tongue piece 74 bent backward and the flange edge 73 as shown in FIG. 14.

The partner-side plug-terminal 81 pushes the tongue piece 74 toward the base plate 71 and flexes the flange edge 73 so as to make the flange edge 73 come into contact with the terminal 81. The terminal 81 comes to rest surely between the tongue piece 74 and the flange edge 73. Accordingly, the lock lance 76 is engaged with the lock hole 82 to thereby prevent the partner-side plug terminal 81 from coming off. In addition one of the connector terminals 64*a*, 64*b* and 64*c* is electrically connected to the partner-side plug terminal 81.

Next, releasing the lock between each of the connector terminals 64*a*, 64*b* and 64*c* and the partner-side plug terminal 81 will be described. Lock releasing plates 91 are provided on opposing sides of the housing 62 and outside the connector terminals 64*a* and 64*c* as shown in FIG. 10. Each of these lock releasing plates 91 has a shape as if it is cut out from the housing 62 partially so as to be able to be pushed as shown in FIG. 11. As a result, the lock releasing plates 91 can be transformed flexibly toward the inside of the housing 62 by hand.

That is, when each of the lock releasing plates 91 is pushed in the direction of arrow A as shown in FIG. 14, the lock releasing plate 91 is transformed flexibly as shown by the dotted lines so that the releasing operation portion 75 formed on the free end side of the tongue piece 74 is pushed toward the base plate 71. As a result, the tongue piece 74 is transformed as shown by the dotted lines so that the lock lance 76 is removed from the lock hole 82 to release the lock. Then, the partner-side plug terminal 81 can be detached from the connector terminals 64*a* and 64*c*.

In the above-mentioned lock releasing mechanism of connector terminals, however, when two partner-side plug terminals 81 connected to a pair of connector terminals 64*a* and 64*c* are removed, the lock releasing plate 91 associated with one of the connector terminals 64*a* and 64*c* is transformed flexibly toward the inside of the housing 62 so as to remove one of the partner-side plug terminals 81. Then the other lock releasing plate 91 associated with the other one of the connector terminals 64*a* and 64*c* is flexibly transformed to remove the other partner-side plug terminal 81. Because the work of releasing must be performed in such a procedure, there is a problem on the workability in maintenance.

In addition, the releasing operation portions 75 of the connector terminals 64*a* and 64*c* are disposed outside in order to be associated with the lock releasing plates 91. However, the electric wires 65*a* and 65*c* are designed to be led out to the outside of the housing 62 at the point requiring the shortest length of wire. Therefore, the respective configurations of the connector terminals 64*a* and 64*c* may be the same in the portions shown by the solid lines in FIG. 12, but they must be reversed in the portions where clamping and connection of the electric wires 65*a* and 65*c* are carried out.

For example, when a connector terminal shown in FIG. 12 is the connector terminal 64*c*, the electric wire 65*a* of the connector terminal 64*a* is designed to be led out in the opposite direction of that shown in FIG. 12. Accordingly, it is necessary to provide two kinds of connector terminals. This is a cause of increasing the number of parts and assembling processes, and hence a cause of increasing the cost.

In addition to the above-mentioned connector 61, an example of connector entitled "Multiple Adaptor for Electric Connection between a Plate-like Terminal of an Electrical Apparatus and a Ribbon-like Electric Wire" is disclosed, in Japanese Patent Unexamined Publication No. Sho. 50-151389, and another example entitled "Connector" is disclosed in Japanese Patent Unexamined Publication No. Hei. 4-14775.

However, the multiple adaptor disclosed in Japanese Patent Unexamined Publication No. Sho. 50-151389 is to perform locking and lock releasing by use of a member separate from a in housing. Accordingly, the number of parts is increased. In addition, only one of a plurality of connector terminals cannot be disconnected.

On the other hand, in the connector disclosed in Japanese Patent Unexamined Publication No. Hei. 4-14775, a lock releasing rod is formed integrally with a housing, but it is not to perform lock releasing upon connector terminals disposed on opposing sides at a predetermined distance as in the connector 61.

SUMMARY OF THE INVENTION

It is an object of the present invention to provide a lock releasing mechanism of a connector, wherein connector terminals can be made to have a common form, connections with partner-side connection terminals can be released easily by one-touch operation, and the number of parts can be reduced to thereby reduce the cost.

In order to achieve the above object, the present invention provides a lock releasing mechanism of a connector comprising: a housing; a plurality of terminal receiving chambers provided in the housing; a plurality of connector terminals received in the terminal receiving chambers so that partner-side connection terminals can be electrically connected to the connector terminals and a plurality of electric wires connected to the connector terminals, wherein each of the connector terminals includes a base plate and a tongue piece for elastically contacting a corresponding one of the partner-side connection terminals, a pair of the connector terminals are disposed so as to face each other such that the base plate and the tongue piece of each of the pair of connector terminals face outward and inward respectively, all of the electric wires are laid such that they are led out of the housing on substantially the same side, and at least one of the electric wires is laid along a wiring groove provided in an outside of the terminal receiving chambers.

Further, the present invention provides a lock releasing mechanism of a connector in which a plurality of connector terminals are received in a plurality of terminal receiving chambers provided in a housing so that partner-side connection terminals can be electrically connected to the connector terminals, the mechanism comprising: a movable plate provided so as to constitute a part of the housing and so as to be able to be pushed into an inside of the housing; a pair of pushing members provided on an inside surface of the movable plate so as to project therefrom and so as to be moved together with the movable plate; and lock releasing levers adapted to be pushed by the pushing members so as to simultaneously urge respective tongue pieces of at least a pair of the connector terminals to thereby release at least two partner-side connection terminals together from the pair of connector terminals.

Furthermore, the present invention provides a lock releasing mechanism of a connector in which a plurality of connector terminals are received in a plurality of terminal receiving chambers provided in a housing so that partner-side connection terminals can be electrically connected to the connector terminals, the mechanism comprising: a movable plate provided so as to constitute a part of the housing and so as to be able to be pushed into an inside of the housing; a pair of pushing members provided on an inside surface of the movable plate so as to project therefrom and so as to be moved together with the movable plate; and a lock releasing arm adapted to convert a moving direction of the pushing members correspondingly to a movement of the pushing members to thereby simultaneously urge respective tongue pieces of at least a pair of the connector terminals to release at least two partner-side connection terminals together from said pair of connector terminals.

BRIEF DESCRIPTION OF THE DRAWINGS

5

DETAILED DESCRIPTION OF THE PREFERRED EMBODIMENTS

Figure 1:
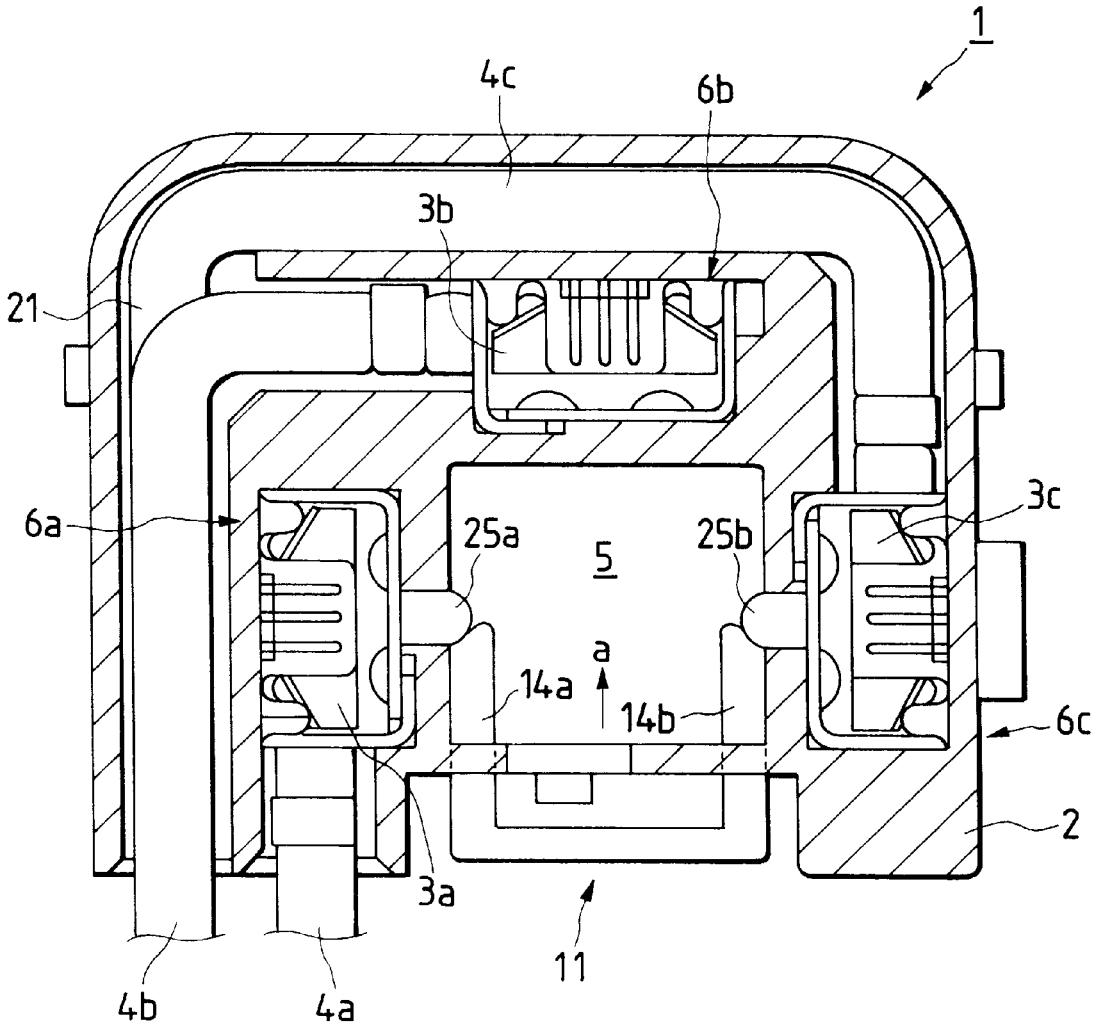
FIG. 1 is a sectional view illustrating a first embodiment of a lock releasing mechanism of a connector according to the present invention.
Figure 2:
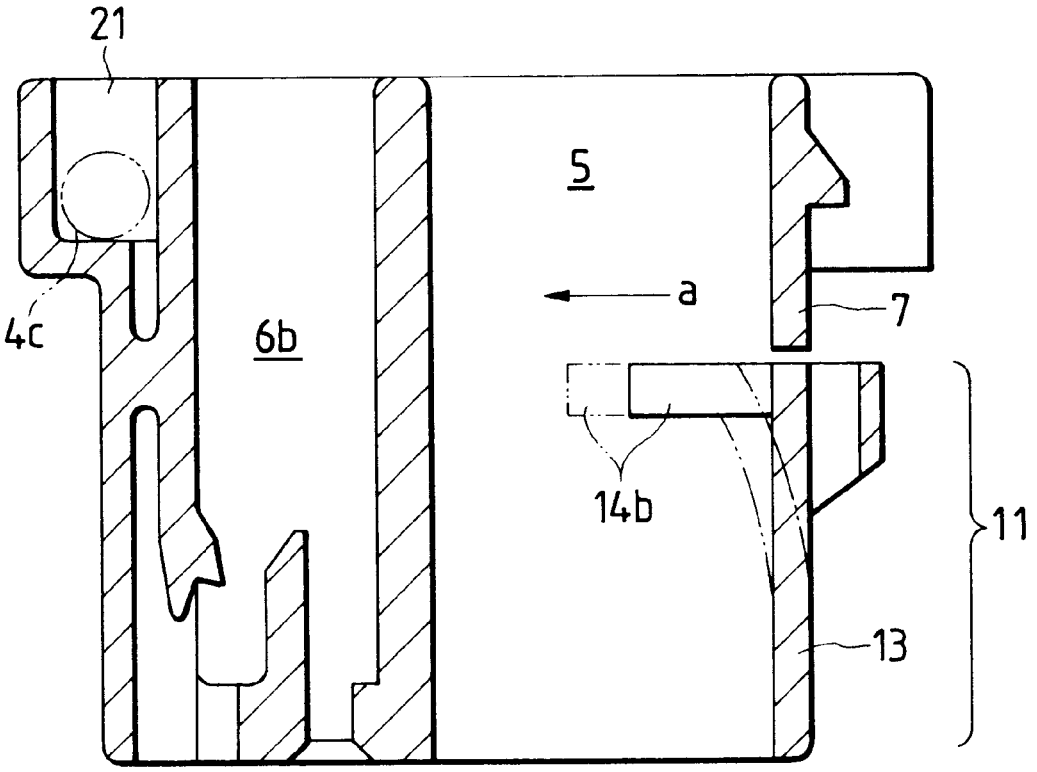
FIG. 2 is a sectional view of a main portion illustrating the configuration of a housing in FIG. 1.
Figure 3:
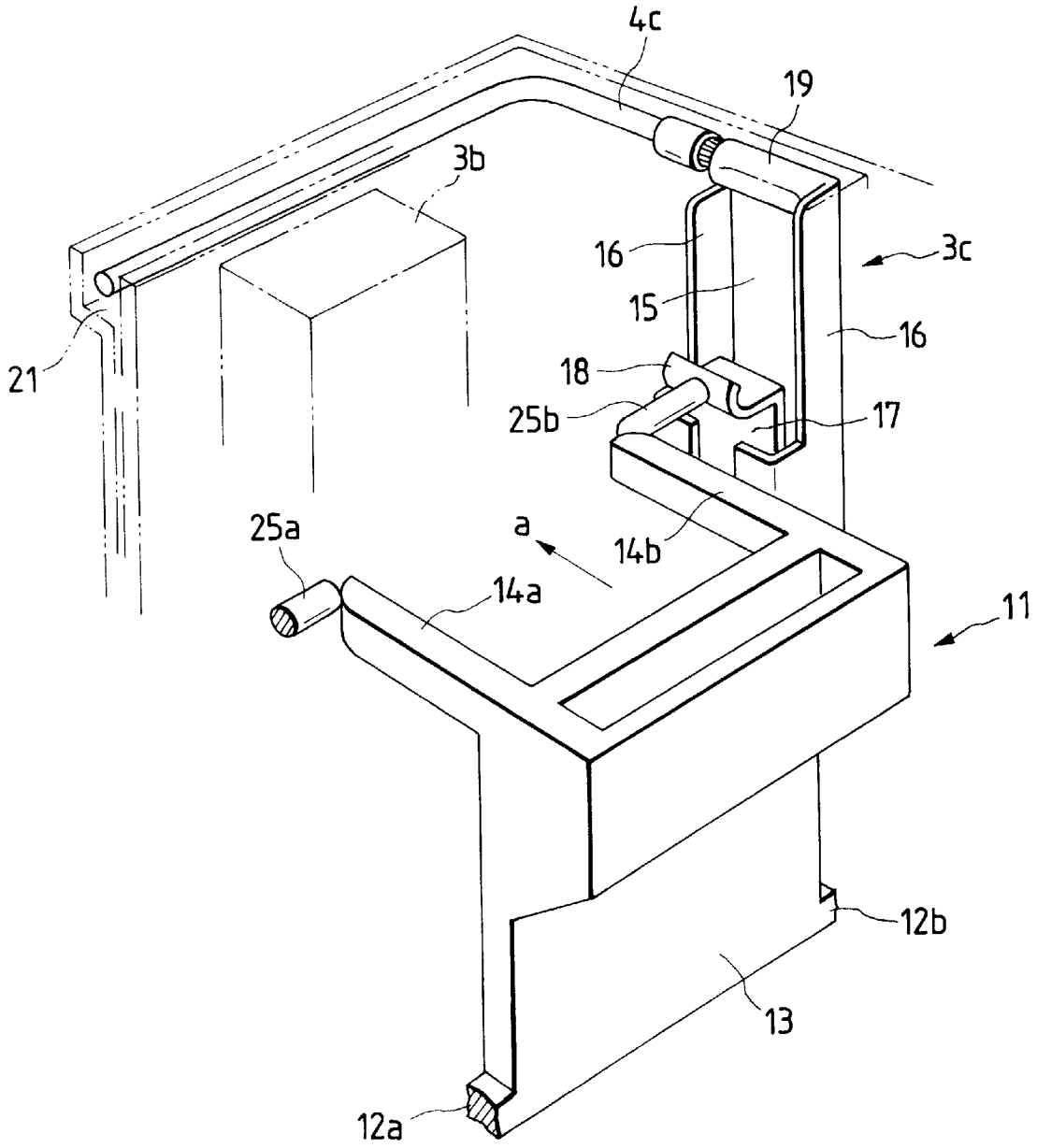
FIG. 3 is a partially perspective view of a main portion illustrating the configuration of a lock releasing member in FIG. 1.

A first embodiment of a lock releasing mechanism of a connector to which the present invention has been applied will be described in detail below with reference to FIGS. 1 to 3. FIG. 1 is a sectional view illustrating the first embodiment of a lock releasing mechanism of a connector according to the present invention; FIG. 2 is a vertical sectional view illustrating the configuration of a connector housing in FIG. 1; and FIG. 3 is a partially schematic view illustrating a lock releasing mechanism in FIG. 1. The drawings used for describing the conventional example will be used, in accordance with necessity, in the description of this embodiment.

As shown in FIGS. 1 and 2, a connector 1 in this embodiment is applicable for controlling lighting of a head lamp of an automobile. The connector 1 comprises a box-like housing 2 integrally molded with synthetic resin, three female connector terminals 3*a*, 3*b* and 3*c* received in the housing 2, and electric wires 4*a*, 4*b* and 4*c* connected to the respective connector terminals 3*a*, 3*b* and 3*c* by clamping or the like.

In the housing 2, a draw hole 5 is formed at the center portion, and terminal receiving chambers 6*a*, 6*b* and 6*c* which are rectangular spaces are formed at angles of 90° on three sides of the draw hole 5. The side of the housing 2 in which the terminal receiving chambers 6*a*, 6*b* and 6*c* are not formed is divided into two portions so that the lower portion constitutes a flexible lock releasing member 11.

A wiring groove 21 for laying the electric wires 4*b* and 4*c* is formed on the upper end of the housing 2. This wiring groove 21 is formed so as to lead the electric wire 4*c* connected to the connector terminal 3*c* toward the backs of the connector terminals 3*b* and 3*a*. Thus, the electric wire 4*c* is led out from the same side of the housing 2 together with the electric wire 4*b* connected to the connector terminal 3*b* so that they are laid one on the other. The depth of the wiring groove 21 is set to an enough size to lay two electric wires laid one on the other, and the width is set to an enough size to lay an electric wire without looseness, as shown in FIG. 2.

With this wiring groove 21 thus provided, the lead-out direction of the electric wires 4*a*, 4*b* and 4*c* connected to the respective connector terminals 3*a*, 3*b* and 3*c* can be made one and the same, that is, counterclockwise in the example shown in FIG. 1. Accordingly, it is possible to make the respective connector terminals 3*a*, 3*b* and 3*c* have the same configuration having a common form.

The lock releasing member 11 will now be described. As shown in FIG. 3, the lock releasing member 11 has base portions 12*a* and 12*b* integrally formed with the housing 2 on opposing ends, a movable plate 13 the upper portion of which is separated by a slit or the like, and a pair of pushing members 14*a* and 14*b* extended from the opposing sides of the movable plate 13 toward the draw hole 5. That is, the lock releasing member 11 is formed integrally with the housing 2, and normally stands upright. Pushed by a finger or the like, the lock releasing member 11 is transformed so as to enter the draw hole 5 as shown by the arrow a. Released from the pushing force, the lock releasing member 11 returns to its original state by its own elastic operation.

Figure 12:
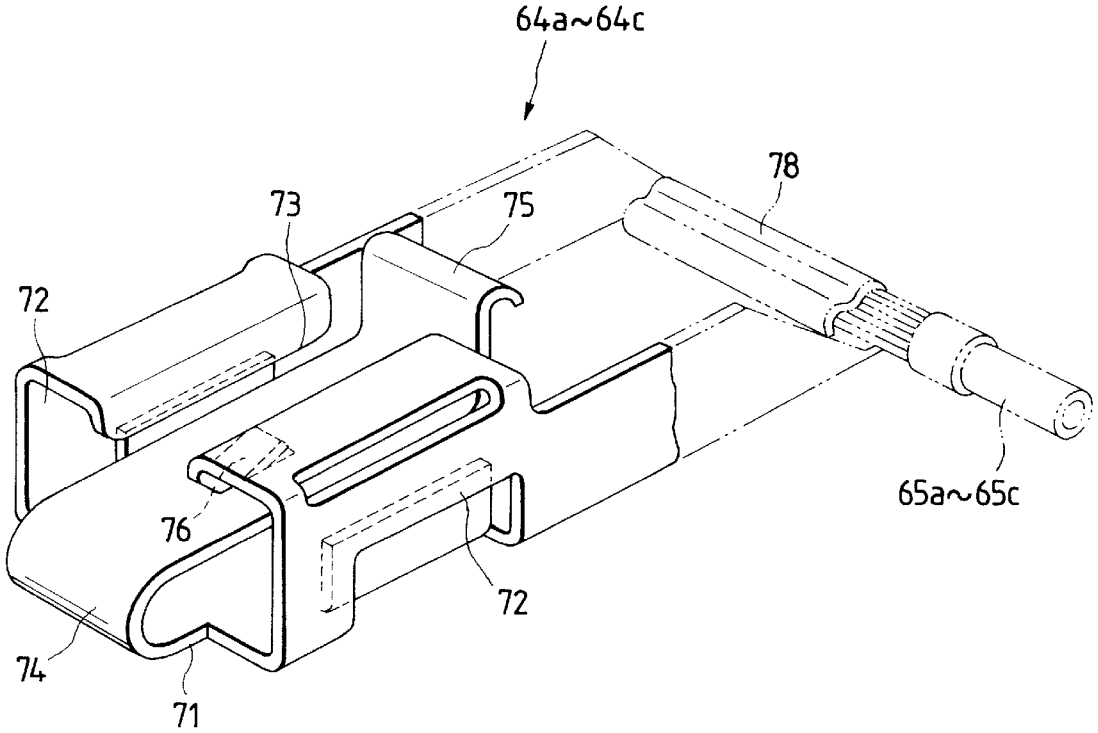
FIG. 12 PRIOR ART
FIG. 12 is a perspective view illustrating an example of a conventional connector terminal.
Figure 13:
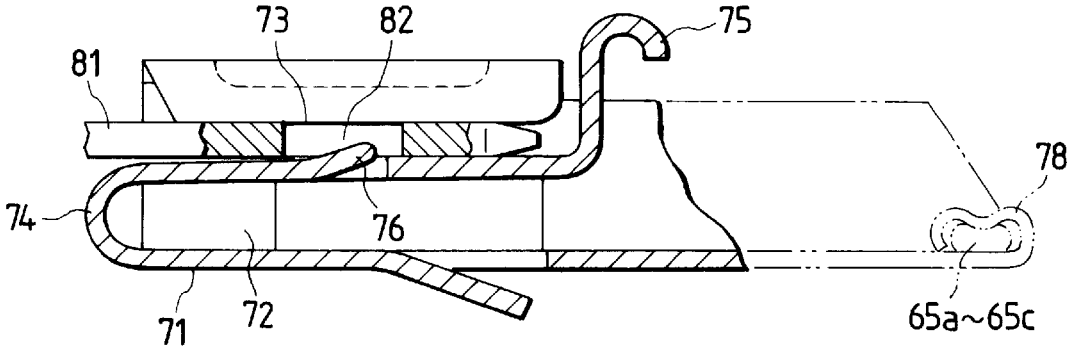
FIG. 13 PRIOR ART
FIG. 13 is a sectional view of a main portion showing the lock releasing of the conventional connector terminal.
Figure 14:
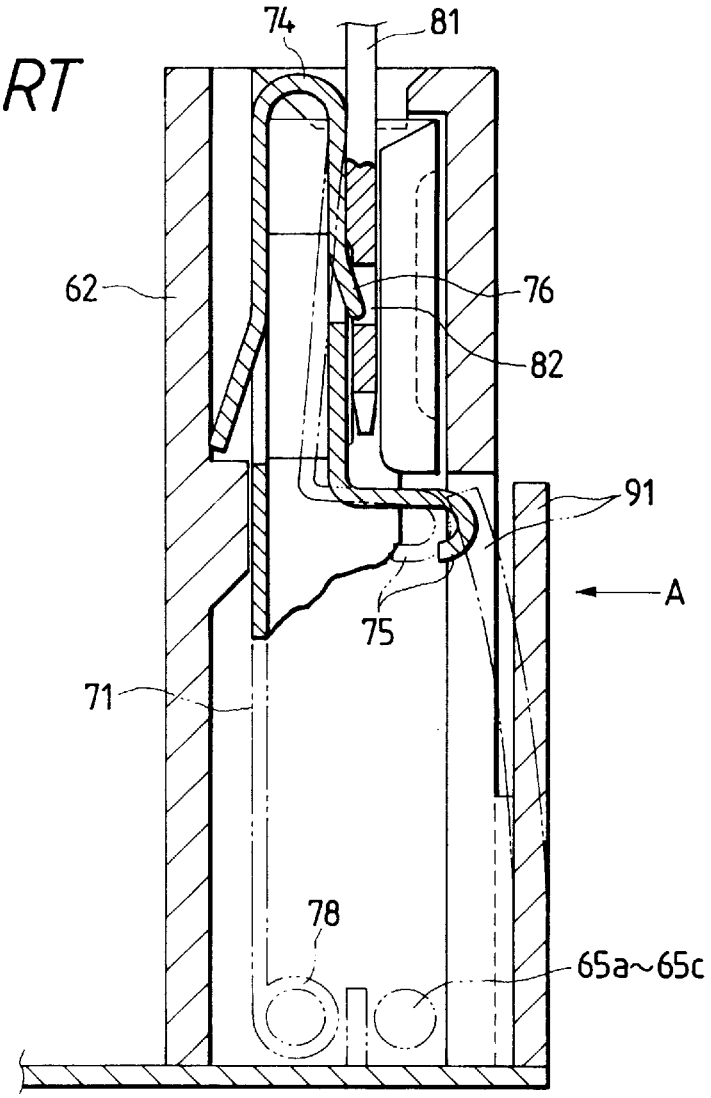
FIG. 14 PRIOR ART
FIG. 14 is a sectional view illustrating the internal configuration of the conventional connector.

The connector terminals 3*a*, 3*b* and 3*c* will now be described. The structure of a lance and so on for locking a partner-side plug terminal is the same as the structure described with reference to FIGS. 12 to 14. Therefore, as partially shown in FIG. 3, side walls 16 are formed on opposing sides of a base plate 15 so as to face each other, and a tongue piece 17 is formed in the inside of the side walls 16 so as to be able to be transformed flexibly. A releasing operation portion 18 is formed at the forward end of the tongue piece 17. A partner-side plug terminal can be released by pushing the releasing operation portion 18. The partner-side plug terminals are plugged into the connector terminals 3*a*, 3*b*, and 3*c* from below in FIG. 3 so as to be electrically connected.

The difference in structure of the connector terminals 3*a*, 3*b* and 3*c* of this embodiment from the conventional connector terminals previously described is in the point that the electric wires 4*a*, 4*b* and 4*c* can be led out in one and the same direction. That is, in this embodiment, as shown in FIGS. 1 and 3, the connector terminals 3*a* and 3*c* are disposed so that the releasing operation portions 18 of the respective tongue pieces 17 face each other, and the electric wires 4*a*, 4*b* and 4*c* are led out counterclockwise. Therefore, the connector terminals 3*a*, 3*b* and 3*c* can have the same structure not only with respect to the locking structure with partner-side plug terminals but also with respect to the clamping portions 19 and so on for connecting the electric wires 4*a*, 4*b* and 4*c*. Although different reference characters are used, the connector terminals 3*a*, 3*b* and 3*c* are the same parts, and it is possible to make the parts have a common form.

As has been described above, making the connector terminals 3*a*, 3*b* and 3*c* have a common form can be realized by providing the wiring groove 21 and laying the electric wires 4*a*, 4*b* and 4*c* in one and the same direction. That is, by providing the wiring groove 21, it is not necessary to reverse the lead-out directions of the electric wires 4*a* and 4*c*, so that it is possible to make the connector terminals 3*a*, 3*b* and 3*c* have one and the same structure.

In addition, the tongue pieces 17 of the connector terminals 3*a* and 3*c* are disposed so as to face each other, so that the partner-side plug terminals can be released together by the single lock releasing member 11. Therefore, when partner-side plug terminals are to be released, the movable plate 13 is flexed in the direction of arrow a, so that the pushing members 14*a* and 14*b* formed integrally with the movable plate 13 are pushed in the direction of arrow a. The outside forward end portions of the pushing members 14*a* and 14*b* are formed into tapered surfaces, and lock releasing levers 25*a* and 25*b* are disposed so as to contact these tapered surfaces respectively. The lock releasing levers 25*a* and 25*b* are columnar; their forward end portions that contact the tapered surfaces of the pushing members 14*a* and 14*b* are formed into round capitals, and the other ends are disposed so as to contact the releasing operation portions 18.

Therefore, when the movable plate 13 is pushed, the lock releasing levers 25*a* and 25*b* are pushed toward the outside by the pushing members 14*a* and 14*b*, so that the releasing operation portions 18 are pushed to transform the tongue pieces 17 flexibly. That is, by pushing the single movable plate 13, the pushing force is divided into two pushing forces in different directions, and these divided forces release the lock lances of the two connector terminals 3*a* and 3*c* together.

In the lock releasing mechanism of a connector in this embodiment described above, partner-side connection terminals locked with the two connector terminals 3*a* and 3*c* can be released together by the single lock releasing member 11 from the inside of the connector terminals 3*a* and 3*c* which are made to face each other. In addition, the draw hole which has been a mere space conventionally is used effectively, so that it is also possible to miniaturize the housing 2.

As a modification of the lock releasing member 11 of this embodiment, a longer pushing member may be provided at the center portion between the pushing members 14*a* and 14*b*, so that a partner-side connection terminal locked with the connector terminal 3*b* can also be released together with the partner-side connection terminals locked with connector terminals 3*a* and 3*c*.

Figure 4:
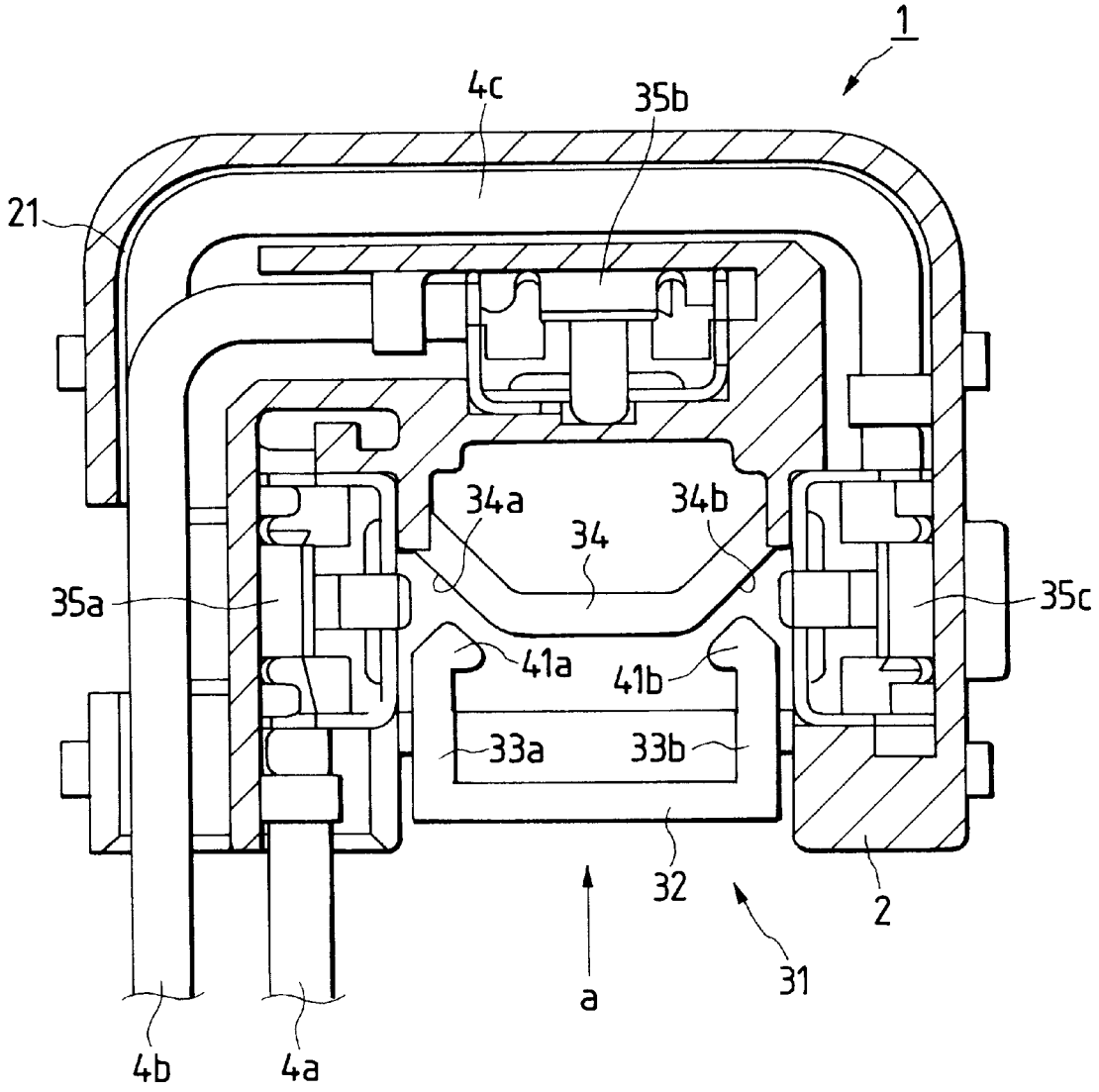
FIG. 4 is a sectional view illustrating a second embodiment of a lock releasing mechanism of a connector according to the present invention.
Figure 5:
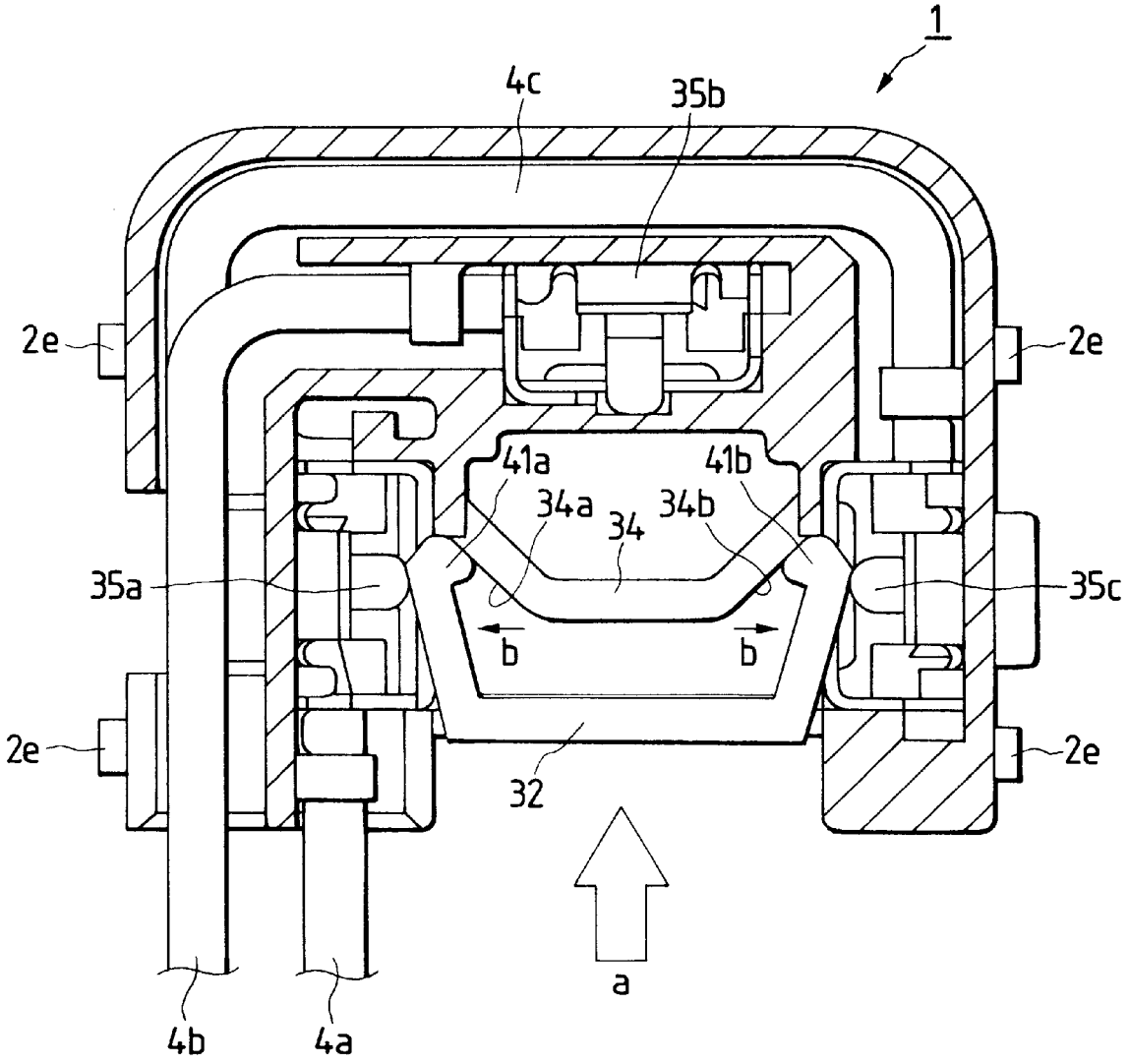
FIG. 5 is a sectional view of a main portion of a housing showing the conversion of the moving direction of a pushing member in FIG. 4.
Figure 6:
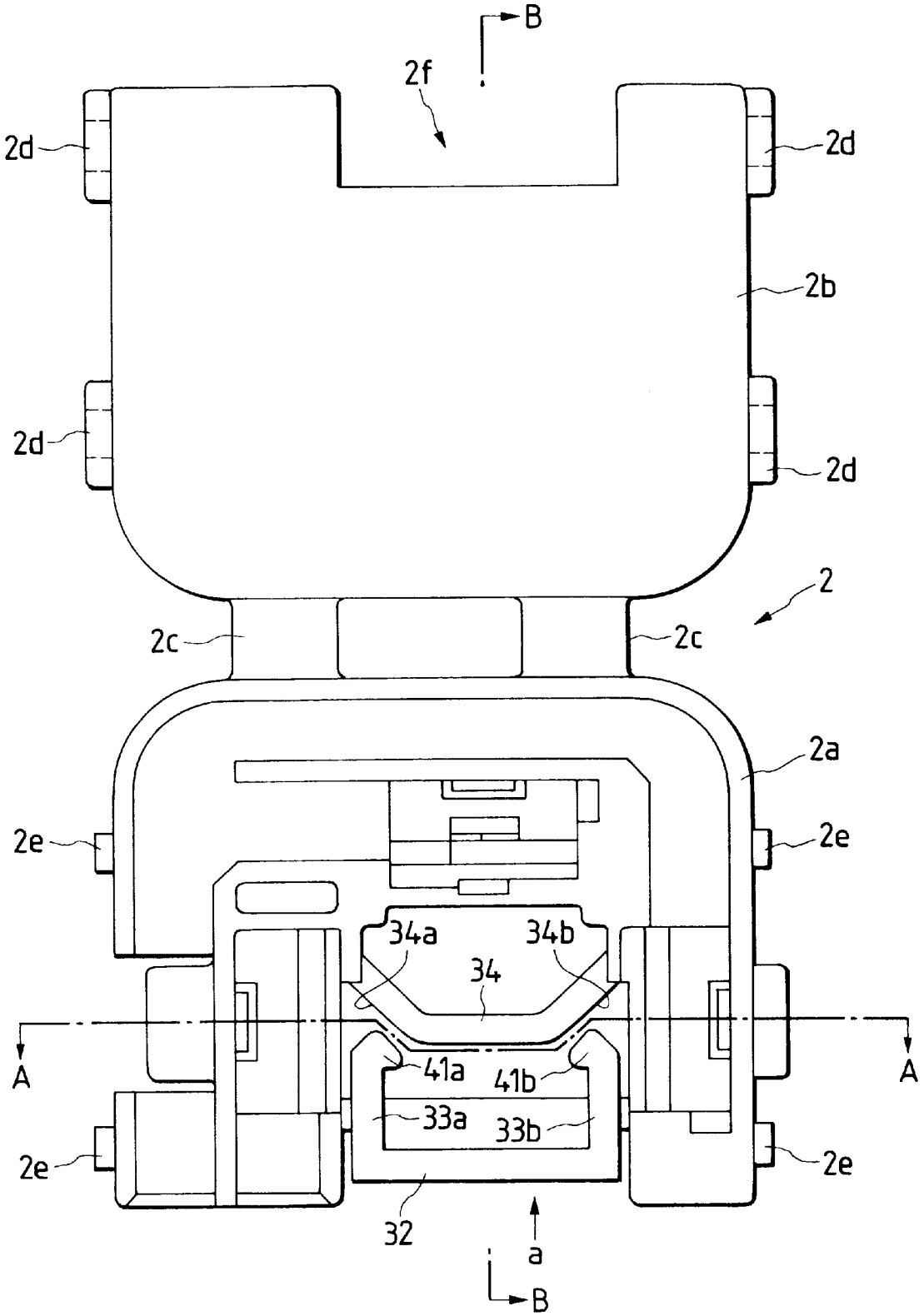
FIG. 6 is a plan view illustrating the configuration of the housing in FIG. 4.
Figure 7:
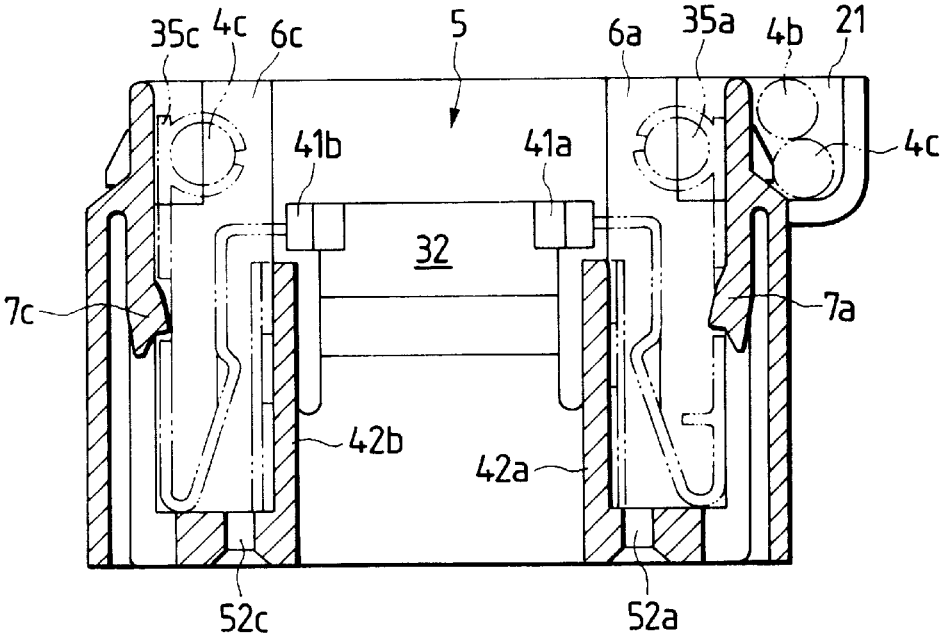
FIG. 7 is a sectional view taken along line A—A in FIG. 6.
Figure 8:
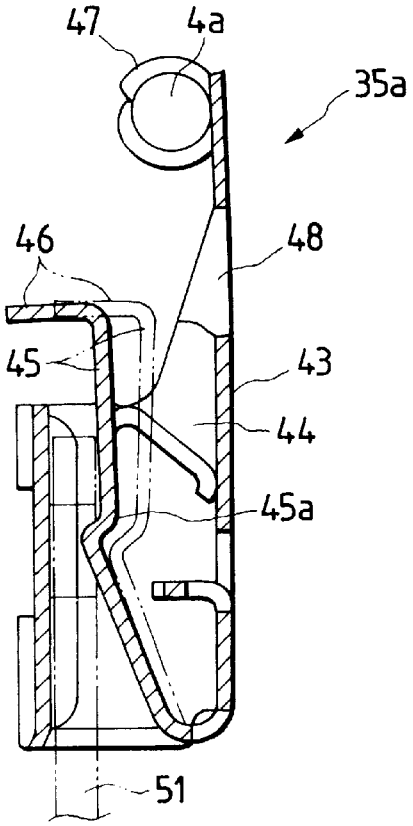
FIG. 8 is a sectional view illustrating the configuration of a connector terminal in FIG. 4.
Figure 9:
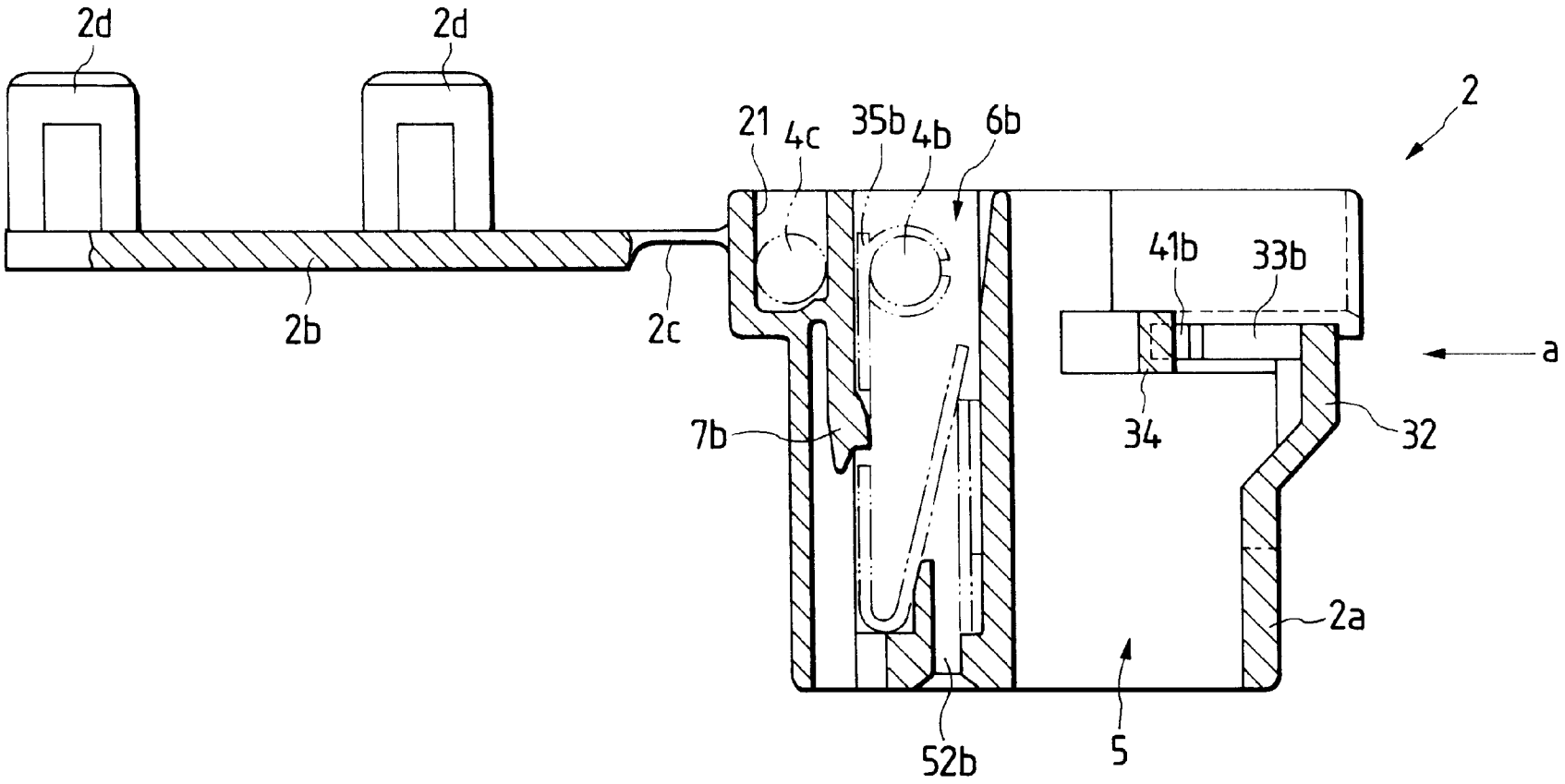
FIG. 9 is a sectional view taken along line B—B in FIG. 6.
Figure 10:
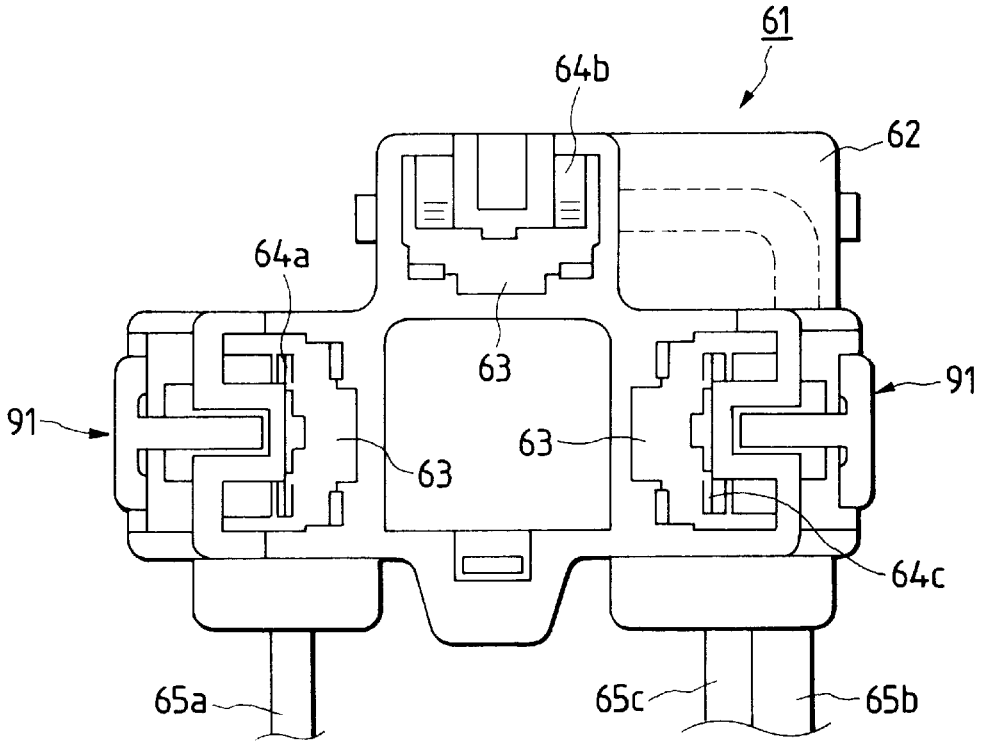
FIG. 10 PRIOR ART
FIG. 10 is a perspective view illustrating an example of configuration of a conventional connector.
Figure 11:
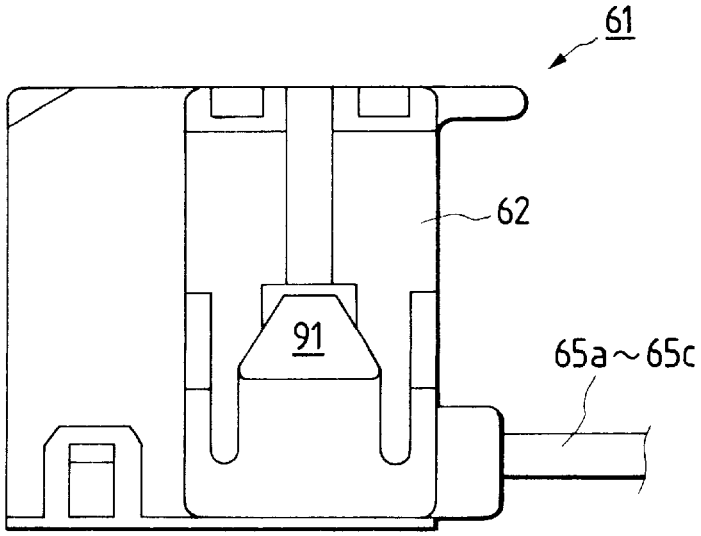
FIG. 11 PRIOR ART
FIG. 11 is a side view illustrating the configuration of external appearance of the conventional connector.

A second embodiment of a lock releasing mechanism of a connector according to the present invention will now be described in detail with reference to FIGS. 4 to 9. FIGS. 4 and 5 are sectional views illustrating the second embodiment of a lock releasing mechanism of a connector according to the 25 present invention; FIG. 6 is a developed plan view illustrating the configuration of a connector housing; FIG. 7 is a sectional view taken along line A—A in FIG. 6; FIG. 8 is a sectional view illustrating the configuration of a connector terminal; and FIG. 9 is a sectional view taken along line B—B in FIG. 6.

The difference of this embodiment from the above-mentioned first embodiment is in the configuration of the lock releasing mechanism. Members having the same configuration and the same operation as those in the first embodiment are referenced correspondingly.

In this embodiment, a lock releasing mechanism 31 provided in a connector 1 is designed so that a movable plate 32 is pushed in the direction of arrow a shown in FIGS. 4 and 5, and flexible pushing members 33*a* and 33*b* provided on opposing sides of the movable plate 32 are brought into contact with a lock releasing arm 34 so as to be flexibly transformed along slope portions 34*a* and 34*b* of the lock releasing arm 34 to thereby release the partner-side connection terminals locked with connector terminal 35*a* and 35*c*.

In this lock releasing mechanism 31, the lock releasing levers 25*a* and 25*b* described in the first embodiment are not necessary, and the configuration of the connector terminals 35*a*, 35*b* and 35*c* is also simplified, as will be described below.

The position and configuration of terminal receiving chambers 6*a*, 6*b* and 6*c* and a wiring groove 21 is the same as those in the first embodiment. Therefore, electric wires 4*a*, 4*b* and 4*c* are laid in one direction to be led out of a housing 2 in the same manner as described above. In addition, the respective connector terminals 35*a*, 35*b* and 35*c* can also have the same configuration in this embodiment.

The configuration of the lock releasing mechanism 31 will now be described more in detail with reference to FIGS. 6 to 9.

First, the configuration of the housing 2 will be described. The housing 2 is constituted by a box-like housing body 2*a*, a plate-like cover 2*b*, and band-like hinges 2*c*, as shown in FIGS. 6, 7 and 9.

As shown in FIG. 9, the base portion of the movable plate 32 is integrated with the wall plate of the housing body 2*a*, and it can be pushed in the direction of arrow a because of the same configuration as that shown in FIG. 3. Pushing portions 41*a* and 41*b* are formed at the forward ends of the pushing members 33*a* and 33*b* provided on opposing sides of the movable plate 32 as shown in FIG. 6.

On the other hand, the lock releasing arm 34 projecting toward the movable plate 32 is provided in a draw hole 5. The opposing sides of the lock releasing arm 34 are formed into the slope portions 34*a* and 34*b* inclined outward from the center. Their slope angles are set so as to be almost along the inclined surfaces of the pushing portions 41*a* and 41*b*. Therefore, when the movable plate 32 is pushed in the direction of arrow a, the pushing members 33*a* and 33*b* move toward the lock releasing arm 34 integrally with the movable plate 32, so that the pushing portions 41*a* and 41*b* contact the slope portions 34*a* and 34*b* formed on the opposing sides of the lock releasing arm 34.

When the movable plate 32 is further pushed in this state, the pushing portions 41*a* and 41*b* move toward the outside along the slope portions 34*a* and 34*b*, so that the pushing members 33*a* and 33*b* as a whole are open toward the outside gradually as shown by the arrow b in FIG. 5. See FIG. 4 for the sake of convenience of description. While the movable plate 32 is not pushed, one-end portions (releasing operation portions 46 shown in FIG. 8) of the connector terminals 35*a* and 35*c* are exposed near the slope portions 34*a* and 34*b*. When the movable plate 32 is pushed to open the pushing members 33*a* and 33*b* toward the outside (in the arrow b direction in FIG. 5), the one-end portions of the connector terminals 35*a* and 35*c* are pushed as shown in FIG. 5 and the partner-side connection terminals 51 which will be described later are released.

The relationship between the terminal receiving chambers 6*a*, 6*b* and 6*c* and the connector terminals 35*a*, 35*b* and 35*c* will now be described more in detail.

The terminal receiving chambers 6*a* and 6*c* are formed on opposing sides of the housing body 2*a* as shown in FIG. 7. Upper portions of inside walls 42*a* and 42*b* defining the terminal receiving chambers 6*a* and 6*c* are notched at the positions corresponding to the height of the pushing portions 41*a* and 41*b* respectively.

The connector terminals 35*a* and 35*c* are received lengthwise as shown by the dotted lines. The one-end portions of the connector terminals 35*a* and 35*c*, that is, the releasing operation portions 46 which will be described later are positioned from the notched positions so that the releasing operation portions 46 contact the pushing portions 41*a* and 41*b* respectively. As a result, partner-side connection terminals can be released by the pushing operation of the movable plate 32.

The connector terminals 35*a*, 35*b* and 35*c* will now be described. The three connector terminals are configured so as to have the same structure by pressing a metal plate. Therefore, the structure and operation of the connector terminal 35*a* shown in FIG. 8 by way of example will be described representatively.

The connector terminal 35*a* has side walls 44, a tongue piece 45, a releasing operation portion 46, a clamping portion 47, and so on, formed integrally with a base plate 43. In addition, a lock protrusion 45*a* is formed substantially at the center of the tongue piece 45 so as with fit to a partner-side connector terminal 51 as shown by the dotted lines in the lower portion of FIG. 8.

In the state where the connector terminal 35*a* is received in the terminal receiving chamber 6*a*, a lock protrusion 7*a* formed in the terminal receiving chamber 6*a* is locked in a lock hole 48 formed in the base plate 43, so that the connector terminal 35*a* is prevented from coming off from the terminal receiving chamber 6*a*.

When the partner-side connector terminal 51 is connected to the connector 1, the partner-side connector terminal 51 is inserted into a terminal insertion hole 52*a* formed at the lower end of the housing body 2*a* so that the terminal 51 is locked with the lock protrusion 45*a*. When the partner-side connector terminal 51 is to be released from connector terminal 35, the movable plate 32 is pushed in the direction of arrow a as described above to open the pushing members 33*a* and 33*b* in the direction of arrow b and to push the releasing operation portion 46. As a result, the tongue piece 45 is flexed and transformed as a whole as shown by the dotted lines in FIG. 8 so as to release the partner-side connector terminal 51 from locking. Consequently, the partner-side connector terminal 51 can be removed.

In the same manner, the connector terminal 35*c* received in the terminal receiving chamber 6*c* is locked on a lock protrusion 7*c*, so that the connector terminal 35*c* is prevented from coming off, and at the same time connected to a partner-side connector terminal 51 or released from locking therewith.

Although the terminal receiving chambers 6*b* receives the connector terminal 35*b* and prevents the connector terminal 35*b* from coming off by the operation of a lock protrusion 7*b*, the terminal receiving chamber 6*b* does not have a lock releasing mechanism for a partner-side connector terminal (not-shown) in this embodiment.

Electric wires 4*a*, 4*b* and 4*c* are connected to the respective connector terminals 35*a*, 35*b* and 35*c* by the respective clamping portions 47, and wired as shown in FIGS. 4 and 5.

After the connector terminals 35*a*, 35*b* and 35*c* are received in the respective receiving chambers 6*a*, 6*b* and 6*c* and wiring is laid as described above, the cover 2*b* is bent onto the housing body 2*a* through the hinges 2*c* as shown in FIG. 6. Four lock members 2*d* formed on the outer circumference of the cover 2*b* are locked with four lock nails 2*e* formed on the outer wall of the housing body 2*a* so that the cover 2*b* covers the upper portion of the housing body 2*a* entirely. Since a notched portion 2*f* is formed in the cover 2*b*, however, the movable plate 32 can be pushed in the direction of arrow a in the state where the upper portion of the housing body 2*a* is covered by the cover 2*b*.

In the connector 1 in the above-described embodiment, the moving direction of the pushing members 33*a* and 33*b* is converted by the slope portions 34*a* and 34*b* of the lock releasing arm 34, and the tongue portions 45 (see FIG. 8) of the connector terminals 35*a* and 35*c* are directly and flexibly transformed. The partner-side connector terminal 51 is released from connector terminals 35*a* and 35*c* in such a manner. Accordingly, not only it is possible to simplify the configuration and hence reduce the number of parts, but also it is possible to miniaturize the connector as a whole.

As has been described above, in the lock releasing mechanism of a connector according to the present invention, the respective tongue pieces of the connector terminals are received so as to face each other in the plurality of terminal receiving chambers formed in the housing, and the respective electric wires connected to the connector terminals are received in the wiring groove provided outside the terminal receiving chambers and led out from one side of the housing. Accordingly, the electric wires connected to the connector terminals can be led out through one and the same position of the housing. Accordingly, the connector terminals may be the same in structure with respect to the connection of the electric wires as well as with respect to the locking with 4. partner-side connection terminals. Thus, it is possible to make all the connector terminals have the same structure, thus allowing the parts have a common form. It is therefore possible to reduce the cost.

Further, since the respective tongue pieces of the connector terminals are disposed so as to face each other, the respective lock releasing levers of the connector terminals can be moved by the single movable plate to push the respective tongue pieces of the connector terminals to thereby release the partner-side connection terminals from the connector terminals together. It is therefore unnecessary to provide a lock releasing mechanism associated with each connector terminal individually, so that the connector structure can be simplified. At the same time, it is possible to release a plurality of partner-side connection terminals from the corresponding connector terminals together thereby improving the workability in maintenance.

What is claimed is:

1. A lock releasing mechanism of a connector comprising:

a housing;

a plurality of terminal receiving chambers provided in said housing;

a plurality of connector terminals received in said terminal receiving chambers so that partner-side connection terminals can be electrically connected to said connector terminals; and a plurality of electric wires connected to said connector terminals, wherein each of said connector terminals includes a base plate and a tongue piece for elastically contacting a corresponding one of the partner-side connection terminals, a pair of said connector terminals are disposed so as to face each other such that the base plate and the tongue piece of each of said pair of connector terminals face outward and inward respectively, all of said electric wires are laid such that they are led out of said housing on substantially the same side, and at least one of said electric wires is laid along a wiring groove provided in an outside of said terminal receiving chambers.

2. The lock releasing mechanism of a connector according to claim 1, wherein in said housing a draw hole is formed at a center portion thereof and three terminal receiving chambers are formed at angles of 90° on three outer sides of said draw hole.

3. The lock releasing mechanism of a connector according to claim 2, wherein a depth of said wiring groove is set to a size large enough to accommodate two electric wires laid one on top of the other.

4. A lock releasing mechanism of a connector in which a plurality of connector terminals are received in a plurality of terminal receiving chambers provided in a housing so that partner-side connection terminals can be electrically connected to said connector terminals, said mechanism comprising:

a movable plate provided so as to constitute a part of the housing and so as to be able to be pushed into an inside of the housing;

a pair of pushing members provided on an inside surface of said movable plate so as to project therefrom and so as to be moved together with said movable plate; and lock releasing levers adapted to be pushed by said pushing members so as to simultaneously urge respective tongue pieces of at least a pair of the connector terminals to thereby release at least two partner-side connection terminals together from said pair of connector terminals.

5. The lock releasing mechanism of a connector according to claim 4, wherein outside forward end portions of said pushing members are formed into tapered surfaces so that said lock releasing levers contact said tapered surfaces.

6. A lock releasing mechanism of a connector in which a plurality of connector terminals are received in a plurality of terminal receiving chambers provided in a housing so that partner-side connection terminals can be electrically connected to said connector terminals, said mechanism comprising:

a movable plate provided so as to constitute a part of the housing and so as to be able to be pushed into an inside of the housing;

a pair of pushing members provided on an inside surface of said movable plate so as to project therefrom and so as to be moved together with said movable plate; and a lock releasing arm adapted to convert a moving direction of said pushing members correspondingly to a movement of said pushing members to thereby simultaneously urge respective tongue pieces of at least a pair of the connector terminals to release at least two partner-side connection terminals together from said pair of connector terminals.

7. The lock releasing mechanism of a connector according to claim 6, wherein opposing sides of said lock releasing arm are formed into sloped portions inclined outward from a center portion thereof so that said pushing members contact said sloped portions.

* * * * *